United States Patent [19]

Orobitg

[11] 3,977,215

[45] Aug. 31, 1976

[54] NEEDLE SELECTOR MECHANISM FOR KNITTING MACHINE

[75] Inventor: Juan-Ramon Moreu Orobitg, Premia De Mar, Spain

[73] Assignee: Jumberca, S.A., Badalona, Spain

[22] Filed: July 11, 1975

[21] Appl. No.: 595,013

[52] U.S. Cl. ..... 66/50 R
[51] Int. Cl.[2] ..... D04B 15/78
[58] Field of Search ..... 66/50 R, 75, 154 A

[56] References Cited

UNITED STATES PATENTS

| | | | |
|---|---|---|---|
| 3,710,594 | 1/1973 | Bourgeois | 66/50 R |
| 3,855,819 | 12/1974 | Sawazaki | 66/50 R |
| 3,890,805 | 6/1975 | Bourgeois | 66/50 R |

*Primary Examiner*—Mervin Stein
*Assistant Examiner*—A. M. Falik
*Attorney, Agent, or Firm*—Staas & Halsey

[57] ABSTRACT

A knitting machine wherein the needle selection is performed electromagnetically by a programmed control. The selector members may occupy an operative and an inoperative position, being associated with resilient recovery means tending to urge said members constantly to one of said positions. They are retained in the other said position by the electromagnetic means and are moved to said other position by cocking members driven by means located essentially on a transmission jack housed in the needle bed, which in turn is driven by the selector members.

3 Claims, 5 Drawing Figures

NEEDLE SELECTOR MECHANISM FOR KNITTING MACHINE

BACKGROUND OF THE INVENTION

The present invention relates to knitting machines and more particularly to knitting machines where the needle selection is performed electromechanically with the aid of data supplied by a numerical programme, for example, or by a magnetic tape or even by a punched tape.

In these knitting machines, each needle is generally controlled by a jack for selectively moving the needle to the operative position. Selection mechanisms controlled by an electromagnet are provided for placing the jack as required in the active position, from which position a cam moves the jack in the needle direction to place the needle directly or indirectly into its operative position. Indeed, in several known mechanisms, the jack moves the needle until a needle butt engages a cam which then carries it to the operative position.

Some of the known devices subject the selector member to a recovery spring which constantly tends to bias this member to the rest position. This arrangement requires an electromagnet sufficiently strong to overcome the bias of the recovery spring.

Other devices do not use a recovery spring to return the selector member to the rest position, but two electromagnets and a permanent magnet attached to the selector member. Thanks to this arrangement, the selector member moves from one electromagnet to the other when their polarity is inverted. Here the use of a spring is avoided by adding a second electromagnet.

A further known device uses two counteracting springs associated with each needle. One of these springs tends to hold the jack constantly in the selection position. At each feed, the second of said springs engages a fixed cam which cocks it with centrifugal movement to move it to the proximity of a fixed selection electromagnet. If the needle should not be selected, this electromagnet repels said second spring which then engages a ramp of a second cam which moves it in a centripetal direction. During this movement, this spring presses the jack against the action of said first spring and thus separates it from the upthrow cam. Otherwise, the electromagnet holds this second spring until it engages with a separation ramp of the second cam, thereby preventing it from operating against the first spring, so that the jack is raised by the upthrow cam.

With this device, the electromagnet works only when in contact with the spring, which is an advantage with respect to the devices where the electromagnet must attract the spring itself.

However, this construction has many other disadvantages. In the first place, it only allows for selection at a single level per feed. Each needle has to be provided with two counteracting springs. Consequently, the number of springs is equal to twice the number of needles. The cocking spring works under disadvantageous conditions, since it has to overcome the bias of the levelling spring.

It is shown that in this construction, the means allowing a reduction of the power of the electromagnet afford disadvantages which are substantially as troublesome as those they allow to be overcome, so that the solution proposed does not provide real technical progress.

Also, certain knitting machines use selection at several levels by disposing several stacked selectors per feed, in order to increase the time available for performing selection, giving the possibility of accelerating the speed of relative movement of the selectors and of the knitting head carrying the needles and, consequently, of increasing production. Therefore, it is important that the selection devices used should be neither too large nor too expensive, while still providing complete operational reliability. The space occupied and the price of the electromagnets is not negligible if one considers that a machine may have, for example, 48 feeds of 10 selectors each, making a total of 480 selectors. If each selector uses two electromagnets, as in one of the aforementioned solutions, 960 would be needed.

SUMMARY OF THE INVENTION

The object of the present invention is to remedy, at least partially, the disadvantages of the abovementioned solutions, whilst increasing the operational reliability of the knitting machine.

To this end, the object of the present invention is a knitting machine having:

a frame, a needle bed rotatably movable with respect to the frame, a plurality of needles mounted in said needle bed and capable of occupying at least an operative position and an inoperative position, a driving device for said needle bed, means for moving said needles from one to the other of said positions and vice versa, a selector means for the position of said needle moving means comprising at least one selector member attached to said frame and capable of occupying an operative position in which it engages said needle moving means and an inoperative position in which it is disassociated from said needle moving means, resilient recovery means tending constantly to bias said selector member to one of said positions, cocking members for moving said selector member from said one position to the other of said positions against the force of said resilient recovery means, and actuating means for said cocking members.

electromagnetic means for selectively retaining said selector member in said other position in accordance with a programmed control.

In the present knitting machine there is a plurality of selection levels and at each thereof the selector member has a first cocking member engaging portion and a second, selector cam shaped portion and the cocking member actuating means comprises an actuating cam and a transmission jack housed in a vertical trick of the needle bed, said jack having a butt adapted for acting as a cocking member against said first portion of the selector member, so that in one stage, under the action of said actuating cams, the selector member is moved to said other position, and in a further stage, said second portion pushes or refrains from pushing said transmission jack, according to whether said electromagnetic retaining means release or retain said selector member in said other position.

As a result of the cocking members being located on transmission jacks housed in the vertical tricks of the needle bed, they are moved by the bed and this allows strict synchronisation of the functions to be obtained.

Also it allows the resilient recovery means to be associated with the selector member and not with the needles, which is a great advantage. The number of springs will, indeed, be equal to the number of selector member and no longer to twice the number of needles, as in one of the abovementioned solutions. Also, the transfer of the springs from the needles to the selectors allows several selector members to be arranged per feed. Finally, the selector member is subject to the action of only one recovery spring.

BRIEF DESCRIPTION OF THE DRAWINGS

The attached drawings show only as an example two embodiments of the knitting machine of the present invention.

DESCRIPTION OF THE PREFERRED EMBODIMENTS

Figure 1:
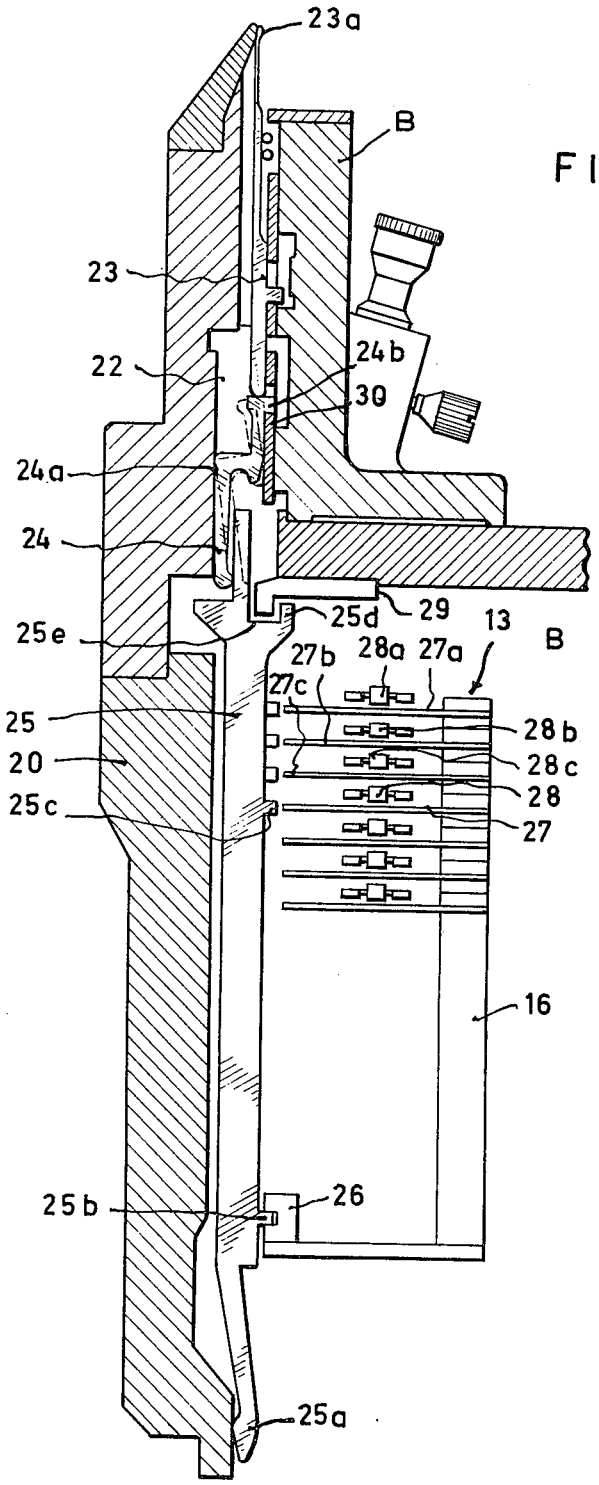
FIG. 1 is a partial diametrical cross section view along the line I—I of FIG. 1A, of a first embodiment of the knitting machine.

The exemplary knitting machine shown in the drawing is a circular Jacquard type machine. Nevertheless, it is obvious that the principles of the selection mechanism more particularly described and shown are applicable to the selection of the needles of flat knitting machines.

Figure 1A:
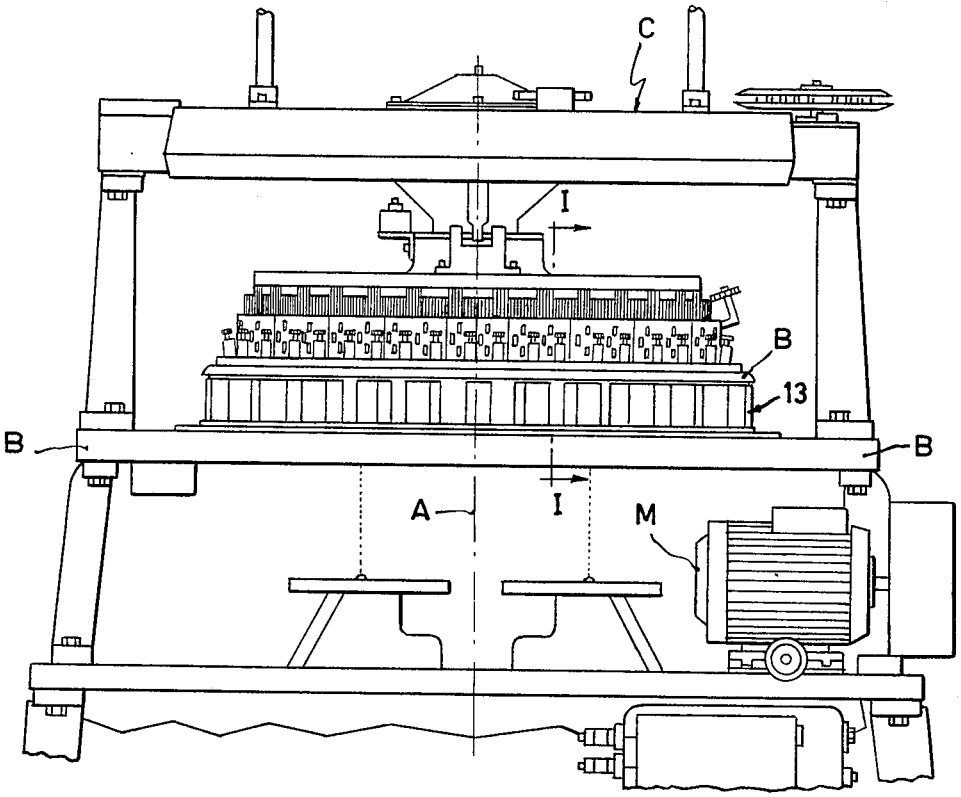
FIG. 1A is an elevation view, partially in section, of a Jacquard type circular knitting machine from which several peripheral members attached to the machine frame, such as legs, feed creel, take-up beam, etc. have been removed.

In FIG. 1A, in particular, there is to be seen a circular knitting machine C, the needle bed of which (not shown) is mounted in a frame B for rotation around an axis A and caused to rotate by a motor M.

Figure 2:
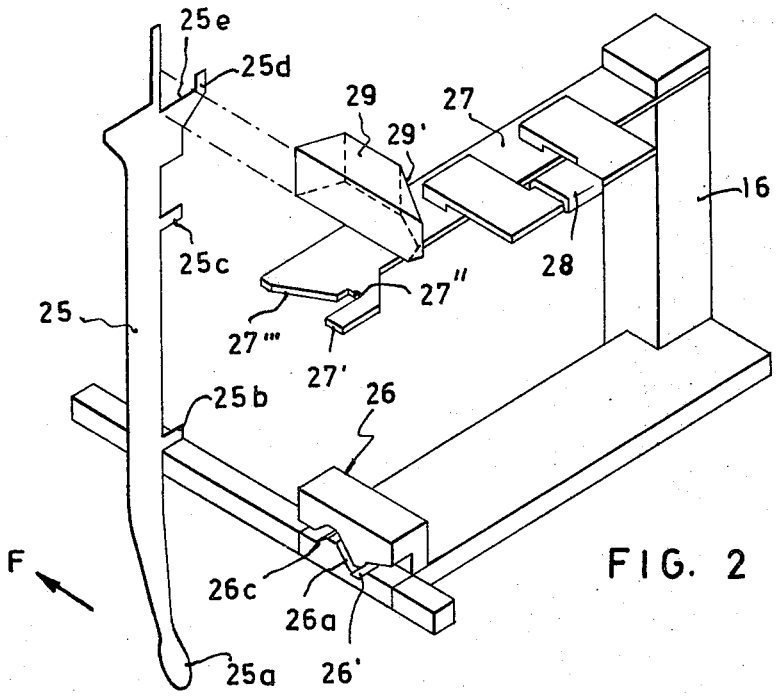
FIG. 2 is a perspective view of the diverse functional elements of the selector means of the embodiment of FIG. 1.

Reference is now made in detail to the structure of the arrangement shown in FIGS. 1 and 2. The needle cylinder 20 of this circular knitting machine is mounted in a frame (not shown) for rotation around a vertical axis and caused to rotate by a motor (not shown) in the direction of the arrow F (FIG. 2).

Figure 4:
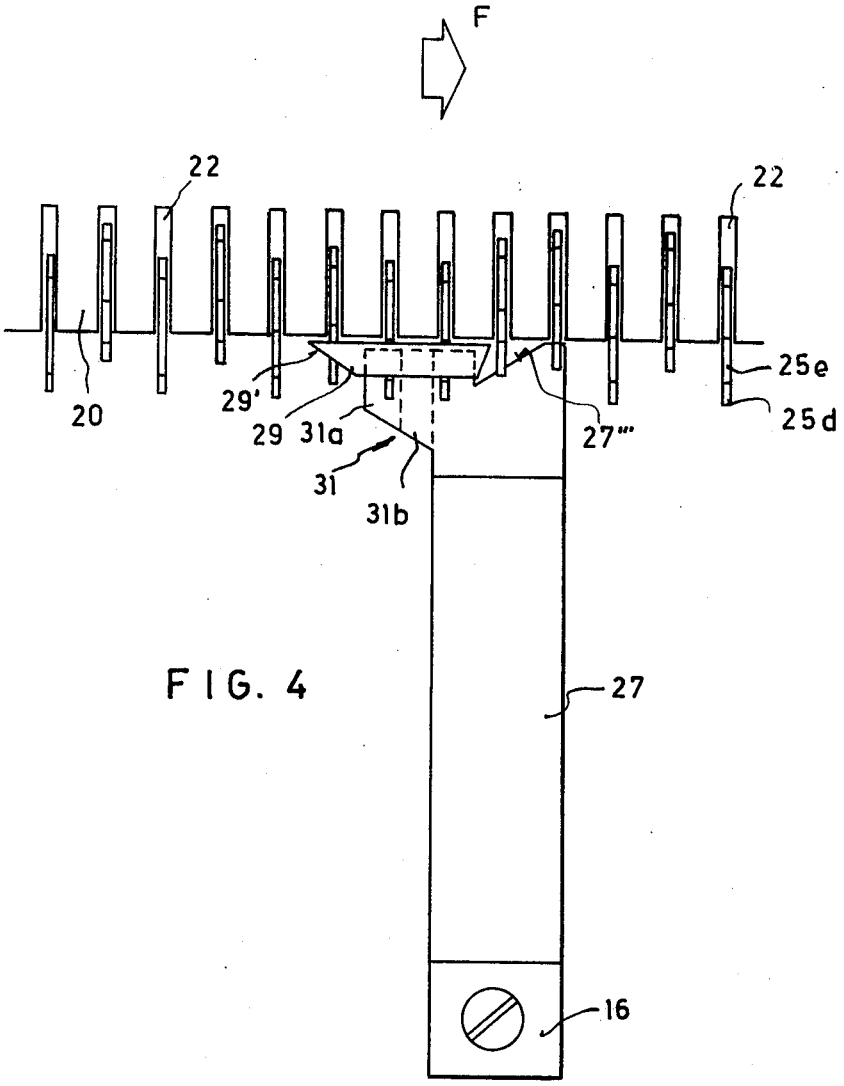
FIG. 4 is a top view of some of the functional elements of the selector means of the first and second embodiment, wherein the needle bed has been illustrated in one dimension for better understanding.

A plurality of radial tricks 22, one of which is visible in FIG. 1, and a plurality of which is shown in FIG. 4, are arranged on the outer surface of the needle bed 20. Each trick 22 houses a needle 23, the upper end of which terminates in a latch 23*a*, and a jack 24. Said jack 24 is mounted slidingly and rockingly in the trick 22. Rocking takes place around its elbow 24*a* and is controlled by a selection transmission jack 25 which rocks around a rounded surface 25*a* arranged at its lower end and which bears against the needle bed 20. Said jack 25 has two butts 25*b* and 25*c*. Butt 25*b* situated towards the lower end of the jack 25 is arranged to engage periodically a fixed cam 26, the purpose of which will be explained hereinafter; this fixed cam 26 has a preparation ramp 26′, a cocking ramp 26*a* and an uncocking ramp 26*c*. The upper butt 25*c* cooperates with the selector member 27. Said selector member 27 is constituted by a resilient strip attached at one end to a support 16 attached to the knitting machine frame.

Said resilient strip of said selector member in the free state forms an angle of 90° with the attachment support 16.

Although only one selector member 27 has been shown in FIG. 2, each feed will have several stacked selector members 27*a*, 27*b*, 27*c* . . . as shown in FIG. 1. Therefore, the upper butts 25*c* of the different transmission jacks 25 will be situated at respective levels corresponding to the levels of the selector members with which they are associated.

The armatures of the electromagnets 28, 28*a*, 28*b*, 28*c* . . . . extend over the resilient strips of the selector members 27, 27*a*, 27*b*, 27*c* . . . . and are arranged in such a way as to make contact with the upper surface of these selector members when the resilient strips are raised in an angle with respect to their rest position. These electromagnets are connected selectively to a control unit programmed for the pattern to be knitted. Also, a kinematic link (not shown) connects the control unit to the knitting machine driving device. This control unit is based on a system of binary information synchronised with the angular movement of the needle bed 20, in order to send pulses as required to the respective electromagnets at the time of selecting the respective needles, as will be explained in greater detail in the description of the operation of the knitting machine to be given below.

The selection transmission jack 25 also has a laterally extending bent arm 25*d* having a recess 25*e* which, when the jack is caused to rotate by the needle bed 20, describes a path along which there is a fixed levelling cam 29 for causing the selection transmission jack 25 to rock towards the right with respect to the position shown in FIG. 1.

As will be seen in FIG. 2, the leading end of the selector member 27 has three portions 27′, 27″ and 27‴.

Portion 27′ constitutes the cocking member engaging portion, portion 27″ provides a gap between the cocking member engaging portion 27′ and portion 27‴ which constitutes the selector cam proper.

The above described selection mechanism works as follows:

The selection transmission jack 25 moves in the direction of the arrow F. The lower butt 25*b* engages first of all in the slot of the fixed cam 26 and, simultaneously, the start of the levelling cam 29 engages behind the bent arm 25*e* of the selection jack. The sloping portion 29′ of this cam causes the jack 25 to rock outwardly. When this rocking movement is finished, the preparation ramp 26′ of the fixed cam 26 causes jack 25 to descend slightly so as to carry its upper butt 25*c* to a level lower than that of the selector member 27. Butt 25*c* is then positioned under portion 27′ of the selector member and, simultaneously, jack 25 is lifted by the cocking ramp 26*a* of cam 26. This movement of the jack 25 cocks the selector member 27 by raising it upwards and bringing it into contact with the armature of the electromagnet 28. At that time, the programmed control device sends a pulse or refrains from sending a pulse according to whether the needle 23 should knit or not knit.

Let it be supposed that the electromagnet receives a pulse. The selector member remains attracted to the armature of the electromagnet. Once the butt 25*c* has left portion 27′ of the selector member, the uncocking ramp 26*c* of cam 26 lowers jack 25 slightly while butt 25*c* is in portion 27″ of the selector, preceding cam portion 27‴. Since the selector member 27 is still attracted to the armature of electromagnet 28, butt 25*c* passes under cam 27‴ so that the selection jack remains in the position set by the levelling cam 29. Jack 24 remains in the position shown by the dot and dash line in FIG. 1 so that the head 24*b* of the jack is out of reach of the upthrow cam 30.

If, on the contrary, the electromagnet receives no pulse, the selector member returns to its initial position at the time when the butt 25*c* leaves portion 27′ of the selector member, that is, the selector member drops to return to its position spaced from the electromagnet thanks to its resilience. After the selection jack 25 has returned to its initial level, butt 25*c* engages cam 27‴ of the selector member. This cam pushes the jack 25 inwardly. On rocking, jack 25 carries with it jack 24 which, in turn, then rocks around its elbow 24*a*, carrying the head 24*b* into the path of the upthrow cam 30 which carries the jack 24 and needle 23 to the high position, that is, to the knitting position.

The operation described here for one needle is identical for the other needles, simply the level of the butt 25*c* varies from one jack 25 to another to adapt each jack 25 to the level of the selector member with which it has to work in each feed.

Figure 3:
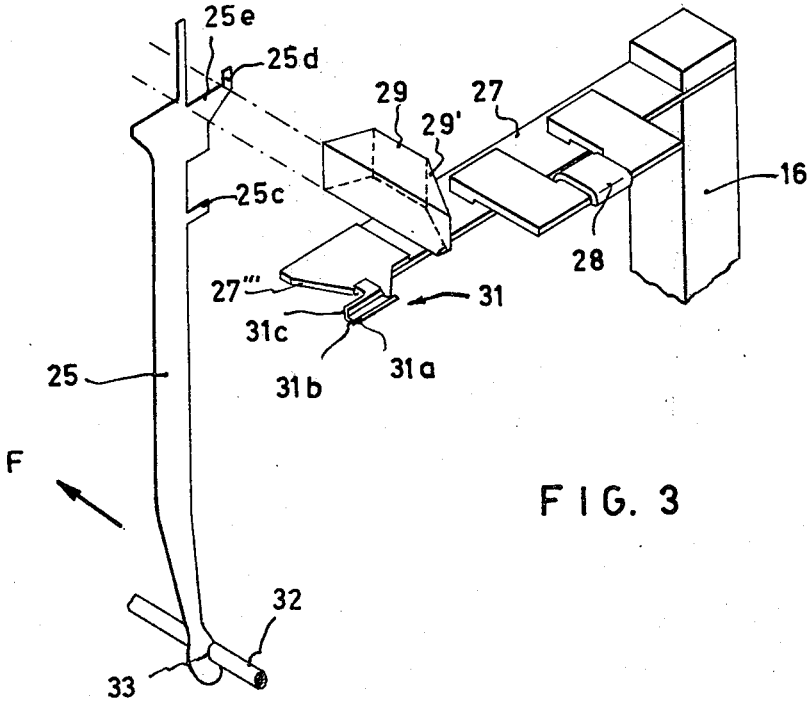
FIG. 3 is a perspective view of the diverse functional elements of the selector means of a second embodiment.

The embodiment of FIG. 3 represents a simplification with respect to the embodiment of FIGS. 1 and 2 and contains several common elements with that embodiment, so that like reference characters are used to designate like parts.

In this embodiment butt 25*b* and the fixed cam 26 have been removed. Fixed cam 26 is replaced by a cam 31 arranged in the portion corresponding to portion 27′ of the selector member 27 of FIG. 2. This cam comprises a cocking ramp 31*a*, a flat portion 31*b* and an uncocking area 31*c*. The rest of the selector member, that is, the selection cam 27‴ is identical to the selector member of FIGS. 1 and 2. In this embodiment, butt 25*c* serves, therefore, at the same time for cocking the selector member when it engages the cocking ramp 31*a* and for causing the selection jack to rock when it engages the selection cam 27‴.

The operation is, therefore, identical to that described for FIGS. 1 and 2, except for the role of cam 26 and butt 25*b*, replaced here by the cam 31 and butt 25*c*.

In its movement in the direction of the arrow F, the transmission jack 25 engages the levelling cam 29 with its bent arm 25*d*, the sloping portion 29′ of said cam causing said jack to rock outwardly. When this rocking movement is finished, butt 25*c* engages the cocking ramp 31*a* which forms a downwardly inclined plane whereby the engagement of the upper edge of butt 25*c* against the upper portion thereof causes the resilient strip of the selector member 27 to rise and to remain in this raised position during its passage under the flat portion 31*b*, and, therefore, in contact with the armature of the electromagnet 28 which, when the butt has moved into the uncocking area 31*c*, may retain said selector member or not.

If the selector member 27 is not retained, under its own resilience it recovers its active position and pushes butt 25*c*, using its portion 27‴ which is the selection cam proper, all of this once the bent arm 25*d* of the jack 25 is no longer guided by the levelling cam 29.

FIG. 4 shows the relative position of the levelling cam 29 and the cam 27‴ of the selector member with respect to the diverse elements of the transmission jack 25, since said Figure shows how in the first place the jack 25 engages the sloping portion 29′ of the levelling cam 29 with its bent arm 25*d*, causing the outward movement of said jack and housing the levelling cam 29 in its recess 25*e*, said cam releasing the jack 25 before cam 27‴ of the selector member 27 pushes the butt 25*c*, not shown in FIG. 4, since it is hidden by the upper end of jack 25. Obviously FIG. 4 illustrates likewise the previous form of selection with reference to the relative positions of the levelling cam 29 and the cam 27‴, showing that their respective operations on the diverse members of the jack 25 are not incompatible.

In the embodiment of FIG. 3, moreover, since the selection transmission jack 25 must raise the selector member 27 without the aid of a cam 26, it is necessary for this jack to be held about the fixed rocking point. For this purpose, the jacks 25 may be retained around the needle bed by a cable or piano wire 32 housed in a recess 33 arranged in the base of the jack 25.

In the embodiment shown in FIG. 3, the great simplicity of selection and also reliability, is to be observed.

Certain advantages of the knitting machine selector mechanism just described have already been listed. This mechanism also provides several constructional advantages which are to be deduced from the preceding description. Among them, it may be mentioned that the springs are replaced by selector members constituted by resilient strips which are extremely pliant in one direction while they are rigid in a direction perpendicular to said one direction. This peculiarity is interesting because the reaction of the butts 25*c* of the jacks 25 against the cams 27‴ of the selector members is produced precisely in the direction of the greatest degree of rigidity of the selector member. On the other hand, the armatures of the electromagnets work in the direction of greatest pliancy of the selector members, so that the reaction of the butts 25*c* against the selector members does not tend to separate the selector members from the armatures of the respective electromagnets.

What I claim is:

1. A knitting machine having a frame, a needle bed rotatably moveable with respect to the frame, a plurality of needles mounted in said needle bed and capable of occupying at least an operative position and an inoperative position, a driving device for said needle bed, means for moving said needles from one to the other of said positions and vice versa, a selector means for the positioning of said needle moving means comprising at least one selector member attached to said frame and capable of occupying an operative position, in which it engages said needle moving means and an inoperative position in which it is disassociated from said needle moving means, resilient recovery means tending constantly to bias said selector member to one of said positions, cocking members for moving said selector member from said one position to the other of said positions against the force of said resilient recovery means, and actuating means for said cocking members, electromagnetic means for selectively retaining said selector member in said other position in accordance with a programmed control, a plurality of selection levels, said selector member at each of said selector levels having a first cocking member engaging portion and a second, selector cam shaped portion and wherein the cocking member actuating means comprises an actuating cam and a transmission jack housed in a vertical trick of the needle bed, said jack having a butt adapted for acting as a cocking member against said first portion of the selector member, so that in one stage, under the action of said actuating cam, the selector member is moved to said other position, and in a further stage, said second portion of said selector member pushes and refrains from pushing said transmission jack, as said electromagnetic retaining means release and retain said selector member in said other position, respectively.

2. The knitting machine of claim 1, wherein said cocking member actuating means comprise a vertically operative cam fixedly disposed with respect to the frame of the knitting machine and a transmission jack slidingly housed in a vertical trick of the needle bed, said jack having a first butt adapted to engage the vertically operative cam and a second butt adapted to act as a cocking member against said first portion of said selector member, so that in one stage it transmits to said selector member the vertical movement caused by said vertically operative cam moving it to said other position and so that in a further stage said second of said selector member pushes and refrains from pushing said second butt of said transmission jack as said electromagnetic retaining means release and retain said selector member in said other position, respectively.

3. The knitting machine of claim 1 wherein said cocking member actuating means comprise a transmission jack housed in a vertical trick of the needle bed, said jack having a double acting butt which in one stage acts as a cocking member on said actuating cam, moving said selector member to said other position and in a second stage said second portion of said selector member pushes or refrains from pushing said double acting butt according to whether said electromagnetic means release or retain said selector member in said other position.

* * * * *